US010281227B1

(12) United States Patent
Champagne et al.

(10) Patent No.: US 10,281,227 B1
(45) **Date of Patent: *May 7, 2019**

(54) COLD SPRAY AND WAAM METHODS FOR MANUFACTURING GUN BARRELS

(71) Applicant: The United States of America as Represented by the Secretary of the Army, Picatinny Arsenal, Dover, NJ (US)

(72) Inventors: Victor Champagne, Dudley, MA (US); Adam Jacob, Broadheadsville, PA (US); Frank Dindl, Newton, NJ (US); Aaron Nardi, East Granby, CT (US); Michael Klecka, Coventry, CT (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 102 days.

This patent is subject to a terminal disclaimer.

(21) Appl. No.: 15/493,913

(22) Filed: Apr. 21, 2017

Related U.S. Application Data

(63) Continuation of application No. 15/493,850, filed on Apr. 21, 2017.

(60) Provisional application No. 62/325,581, filed on Apr. 21, 2016.

(51) Int. Cl.
*F41A 21/04* (2006.01)
*C23C 24/04* (2006.01)

(52) U.S. Cl.
CPC ..... *F41A 21/04* (2013.01); *C23C 24/04* (2013.01)

(58) Field of Classification Search
CPC ..... F41A 21/04
See application file for complete search history.

(56) References Cited

U.S. PATENT DOCUMENTS 9,186,712 B1 11/2015 Wright
9,358,600 B1 6/2016 Wright
9,365,930 B1 * 6/2016 Wright ..... C23C 24/04

* cited by examiner

*Primary Examiner* — Xiao S Zhao
(74) *Attorney, Agent, or Firm* — John P. DiScala

(57) ABSTRACT

A method for manufacturing a gun barrel with a cold spray process. The method includes the use of a mandrel having a tubular body and being made of a material with properties suited to use with gun barrel manufacture and materials and cold spray processes.

23 Claims, 6 Drawing Sheets

COLD SPRAY AND WAAM METHODS FOR MANUFACTURING GUN BARRELS

CROSS-REFERENCE TO RELATED APPLICATIONS

This application claims the benefit under 35 USC § 119(e) of U.S. provisional patent application 62/325,581 filed on Apr. 21, 2016 and is a continuation of U.S. patent application Ser. No. 15/493,850 filed on Apr. 21, 2017

STATEMENT OF GOVERNMENT INTEREST

The inventions described herein may be manufactured, used and licensed by or for the United States Government.

BACKGROUND OF THE INVENTION

The invention relates, in general, to the manufacture of gun barrels and more specifically, to the manufacture of gun barrels using cold spray deposition processes.

The high temperatures experienced by barrel temperature during firing is a common issue with weapon barrels. These high temperatures lead to increased potential for cook off, catastrophic failure of the weapon and premature barrel wear which may lead to increased dispersion among other issues.

For example, operators of crew served machine guns are instructed to change weapon barrels at prescribed intervals based on firing schedules, and must carry spare barrels. This necessity increases a user's load, increases logistics burden to supply and maintain spare barrels and takes the soldier out of the fight when dealing with barrel issues.

Additionally, cutting edge additive manufacturing techniques available in other fields have not been leveraged to produce weapon barrels having advanced material properties.

A need exists for a gun barrel which may withstand the high temperatures experienced during firing and which may be manufactured reliably by an additive manufacture process.

SUMMARY OF INVENTION

One aspect of the invention is a method for manufacturing gun barrels. The method includes the steps of: employing a mandrel having a tubular shape with a wall thickness in the range of approximately 20-200% of a desired build thickness; applying to the mandrel via cold spray deposition a liner comprising a cobalt superalloy; applying to the liner via cold spray deposition a first coating comprising a nickel material; applying to the first coating via cold spray deposition a second coating comprising a metal material; dissolving the mandrel in a chemical solution by circulating the chemical solution within an inner diameter of the mandrel; heat treating the first coating and the second coating to diffusion bond the first coating and the second coating; and applying an outer jacket layer A second aspect of the invention is a method for manufacturing gun barrels. The method includes the steps of: employing a mandrel having a tubular shape with a wall thickness in the range of approximately 20-200% of a desired build thickness; applying to the mandrel via a cold spray deposition process a liner comprising a cobalt superalloy; applying to the liner via a cold spray deposition a first coating comprising a gradient of the cobalt superalloy and a mixture of a ceramic and a metal wherein the gradient transitions from substantially the cobalt superalloy to substantially the mixture of ceramic and metal, and wherein the mixture of ceramic and metal is approximately 75-80% ceramic and 20-25% metal by weight; applying to the first coating via a cold spray deposition process a second coating comprising a gradient of the mixture of ceramic material and metal material and steel wherein the gradient transitions from substantially the mixture of ceramic material and metal material to substantially steel; dissolving the mandrel in a chemical solution by circulating the chemical solution within an inner diameter of the mandrel; heat treating the first coating and the second coating to diffusion bond the first coating and the second coating; and applying an outer jacket layer.

A third aspect of the invention is a method for manufacturing gun barrels. The method includes the steps of: employing a mandrel of a chemically dissolvable material; applying to the mandrel via a cold spray deposition process a liner comprising a mixture of ceramic and cobalt superalloy; applying to the liner via a cold spray deposition process a first coating comprising a gradient of the mixture of ceramic material and metal material and steel wherein the gradient transitions from substantially the mixture of ceramic material and metal material to substantially steel; dissolving the mandrel in a chemical solution; heat treating the first coating to diffusion bond the first coating; applying a second coating comprising steel to the first coating via wire arc additive manufacturing; and applying an outer jacket layer.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

Figure 1:
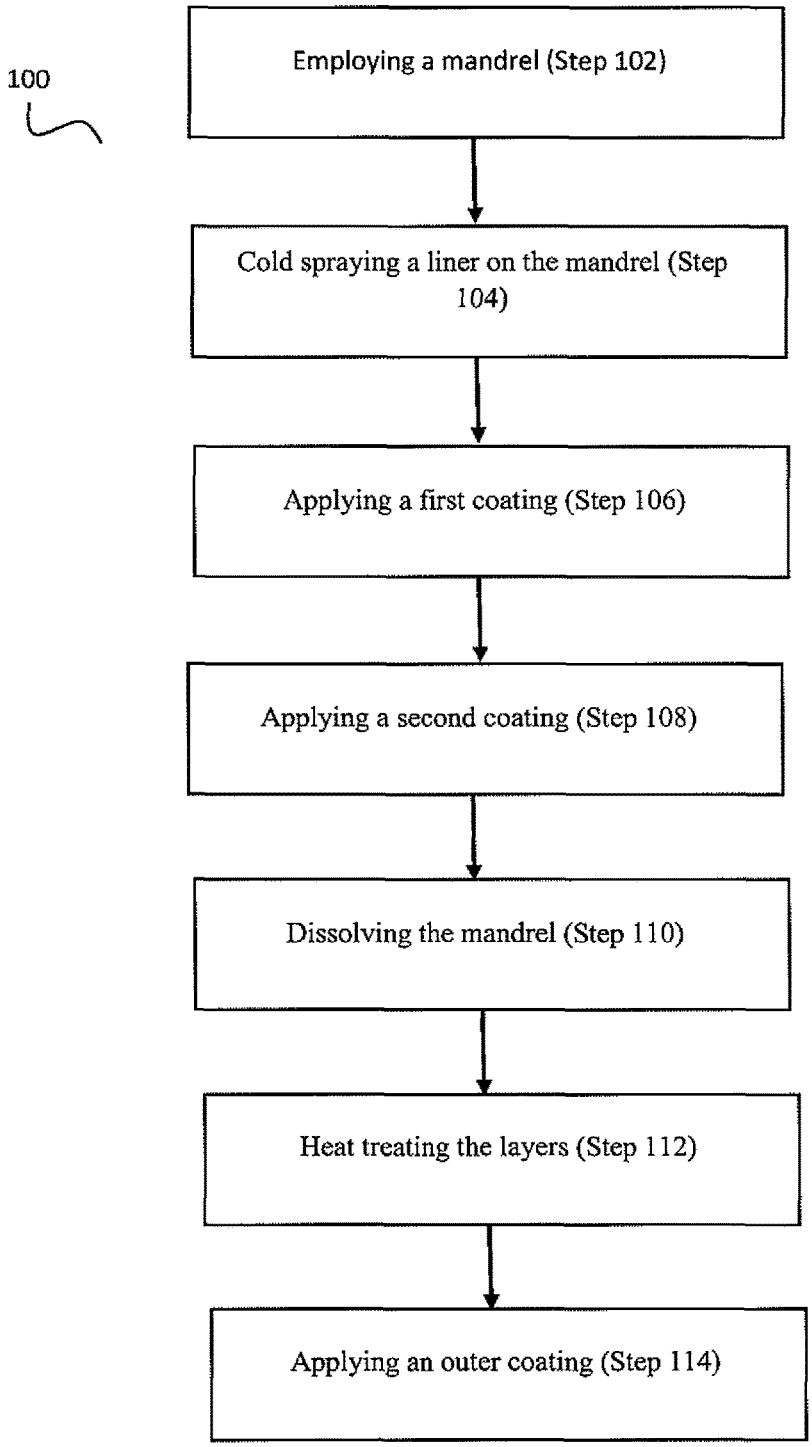
FIG. 1 is a flow diagram illustrating a method for manufacturing a gun barrel, in accordance with an illustrative embodiment of the invention.

Various methods are disclosed for manufacturing a gun barrel using cold spray deposition process and wire arc additive manufacture processes. The methods disclosed herein employ methods, processes, materials and geometries with specific properties to increase the thermal performance of the barrel and the overall life of the barrel.

The methods described below are employed to manufacture a multi-metallic barrel system which includes a liner, a structural core and a jacket. Certain embodiments further include a non-metallic thermal isolating layer in the structural core. Additionally, layers of the structural core may be gradients to ensure strong bonding. The processes and materials are chosen to manage heat in the multi-metallic barrels and increase the overall barrel life.

A cold spray process imparts supersonic velocities to metal particles by placing them in a heated nitrogen or helium gas stream that is expanded through a converging-diverging nozzle. The metal is inserted as a powder feed at high pressure at the nozzle entrance. High pressures and temperatures yield supersonic gas velocities and high particle acceleration within the gas stream. The particles, entrained within the gas, are directed towards the surface, where they embed on impact, forming a strong bond with the surface. The term "cold spray" has been used to describe this process due to the relatively low temperatures (100-500° C.) of the expanded gas stream that exits the nozzle.

Subsequent spray passes increase the structure thickness. The adhesion of the metal powder to the substrate, as well as the cohesion of the deposited material, is accomplished in the solid state. Sprayed particles must reach a "critical velocity" before impact will result in consolidation with the surface. This required minimum velocity varies among metal types and is typically between 500 and 800 m/s. The gas used for particle acceleration is generally nitrogen, helium, or a mixture of the two. While considerably more expensive, helium gas produces much higher particle velocities. The attributes of cold spray include low temperature deposition, dense structures, and minimal or compressive residual stress. In addition to these characteristics, the deposited material possesses strength close to or above that of wrought material.

In addition to the use of cold spray, wire arc additive manufacturing technology may be leveraged to manufacture weapon barrels. WAAM is a method of using a wire arc welding technology to build part features or whole parts additively. Generally this uses the gas metal arc welding process, but can also use an automated gas tungsten arc weld or plasma arc weld process. In each case it is important to select the equipment and the process to control the temperature input during the wire arc process. This WAAM process may be employed to apply a structural steel layer to the weapon barrel. The highly controlled temperature of the wire arc allows for the steel layer to be added without a large heat affected zone that would result from a traditional wire arc. Advantageously, the use of WAAM has the advantage of creating a ductile but tough steel layer that has high bonding strength to the barrel liner.

Each of the methods described below employs a mandrel as a base material for creating the weapon barrel. The mandrel comprises an outer surface having a negative profile of the desired inner profile of the gun barrel. In the case of a gun barrel having rifling, the mandrel would comprise grooves running along its outer surface and corresponding to the desired rifling on the inner surface of the gun barrel.

The mandrel material and configuration are chosen to be compatible with the cold spray methods described below. Extractable mandrels, such as hardened mandrels, which can be broken away from the buildup using mild heating and/or cooling are not suitable for use creating rifled barrels as the geometry will lock the parts together. Further, mandrels formed from low melting metals which are melted thermally are not suitable due to certain materials which may be used. Cobalt based superalloys, for example, are sprayed at stagnation temperatures of 400-600° c. and helium gas pressures of 30-40 bar which generates substrate temperatures which exceed the melting point or soften a low melt material such as tin based alloys or even zinc based alloys. These conditions then result in erosion or otherwise damage the integrity of the mandrel.

Accordingly, the mandrel is formed of a material which can be dissolved from the manufactured part using chemical means safely and effectively. In a preferred embodiment of the invention, the mandrel is formed of aluminum. Aluminum materials which may be used include pure aluminum, 2024 alloy, 6061 alloy and 7075 alloy. However, the mandrel material is not limited to these aluminum alloys. In this embodiment, the chemical means employed to dissolve the mandrel is a caustic solution comprising hydrogen, such as sodium hydroxide. In a continuous fluid flow, sodium hydroxide etches the aluminum evenly. Additionally, the relatively low activity of sodium hydroxide allows for standard manufacturing equipment such as rubber hoses to flow the acid through the mandrel.

In an alternative embodiment, the mandrel is formed of steel. In processes employing a steel mandrel, a nitric acid solution may be used to dissolve the mandrel. Barrel coating material such as high chromium super alloys can withstand contact with nitric acid for the time period required for dissolving a mandrel.

To facilitate dissolution of the mandrel in the chemical solution, the body of the mandrel is a tubular shape having an interior cavity defined by the walls of the mandrel body. The tubular shape allows for the chemical solution to be flowed through the inner cavity.

The thickness of the tube walls must be selected to balance the need for structural integrity of the mandrel under the cold spray and wire arc additive manufacture (WAAM) conditions as well as the need for even and timely dissolution of the mandrel. To reduce etching time, the tube walls should be relatively thin. It is also important for the mandrel to be thin because of thermal expansion mismatches between the mandrel and the likely buildup materials. As heat builds in the mandrel, it is important that the mandrel does not induce strain in the deposit sufficient to initiate a crack in the deposit. The mandrel must therefore give slightly if it is heated to high.

However, the mandrel must also be sufficiently stiff to resist circumferential through wall buckling which can happen with very thin tubes. The tubes must also have sufficient strength to be handled and machined without deforming the geometry. Accordingly, alloyed aluminums are preferred including the 2024, 6061, 7075 alloys described above. However, pure aluminum may also be used.

The wall thickness of the mandrel can vary depending on many of the factors described above but typically should be in the range of 50% of the thickness of the desired build. However, mandrels having a thickness in the range of 20-200% of the desired build may be used as well depending on the exact materials and geometries being used for both the mandrel and build material. For instance when depositing a cobalt alloy and aluminum substrate, a wall thickness of 50% of the nominal buildup may apply.

The manufacture of the mandrel is designed to produce a mandrel having the properties described and suitable for use in the applications described throughout. In one embodiment, a machining process is employed that is sufficiently specialized such that the negative of the desired rifling can be machined into the outer diameter of an aluminum mandrel. The process requires specialized equipment to accurately rotate the tube while milling the groove.

In another embodiment, a cold spray process creates the rifling on a straight round aluminum tube. One or more wires is held under tension between two fixtures and against the surface of the tube. The number of wires is dependent on the desired number of rifling grooves in the resulting barrel. The two fixtures at either end of the wire are rotated relative to each other in such a manner as to create the correct angle of rifling grooves. An aluminum cold spray deposit is then created over the mandrel and wires having a height corresponding to the desired inner surface of the weapon barrel. The wires shadow the portion of the tube under the rifling and thereby create the differential representing the negative of the rifling. The shape of the wire cross section affects the groove geometry and therefore is chosen to create the desired rifling geometry. For example, a square or rectangular cross section wire would create rectangular rifling grooves whereas a round wire creates rounder rifling grooves.

While spraying material onto the mandrel, the mandrel should be cooled to minimize any problems caused by heating of the mandrel as noted previously. The mandrel may be cooled by circulating a cooled fluid, such as a liquid or gas, within the interior diameter of the mandrel. After spraying the mandrel, the mandrel should be dissolved in the chemical solution before any further processing. The resulting additive tube with the weapon barrel inner diameter can be heat treated to diffusion bond the structure.

A liner is formed on the mandrel. The liner can be formed of metal or a blend of metal and ceramic. Preferred materials include a cobalt based superalloy or refractory metals due to the high hot hardness and wear resistance that can be achieved with these materials. For example, stellite alloys are one commercially available cobalt based superalloy. Refractory metals may include alloys containing one or more of titanium, vanadium, chromium, zirconium, niobium, molybdenum, ruthenium, rhodium, hafnium, tantalum, tungsten, rhenium, osmium and iridium. For example, Ta-10W is one such refractory metal which may be employed.

One or more structural layers are applied to the liner using additive manufacture technologies such as a cold spray process or a wire arc additive manufacture process. For example, the one or more structural layers may comprise a high strength steel layer, a ceramic and metallic mixture. In one embodiment, a structural layer of maraging steel is applied via a wire arc additive manufacture process.

In embodiments of the invention, an insulative layer is applied between structural layers. This allows a cobalt superalloy liner to be combined with a ceramic core, resulting in a high strength, thermally insulative barrel that does not absorb the heat from firing. The brittleness of the ceramic is negated by sandwiching, the ceramic between structural layers formed of cobalt superalloy or steel. Even if the ceramic should break, the steel layer provides the structural integrity required while the weapon barrel retains the thermal properties. The insulative layer may be a layer of ceramic material or a layer of a metal ceramic mixture. While ceramic is used as an insulative material throughout this specification, the methods described herein are not limited to employing ceramic as the insulative material. As those skilled in the art will recognize, other materials providing the insulative properties of a ceramic may be employed as well.

The materials of the structural layer and any insulative layer may be graded between layers resulting in a single piece barrel with high bonding between layers. The gradient increases bonding between the layers by preventing separation between layers due to thermal expansion After dissolving the mandrel, the structural and insulative layers are heat treated to diffusion bond the layers.

In general, after the structural layers are applied and heat treated, an outer jacket layer is deposited. As the structural core has been selected to support the pressure loading of the system, the outer jacket layer manages the thermal requirements of the system. Accordingly, the outer jacket is formed of materials with high specific heat material properties. While current approaches to the outer jacket focused on the use of materials with high thermal conductivity to move heat out of the barrel, the inventors have discovered that for machine guns and other similar weapon systems, the specific heat of the jacket material is the primary driver in keeping the barrel under a critical temperature.

Embodiments of the process include one of a titanium outer jacket layer, a steel outer jacket layer or an aluminum outer jacket layer. If the last structural layer is steel and the outer jacket layer is steel, the steel outer jacket layer is applied by wire arc additive manufacture. Alternatively, the outer jacket layer may be applied through a cold spray process.

Geometric features may be included on the outer surface of the weapon barrel to improve performance. For example, fins may be included to dissipate heat. For embodiments in which the outer jacket layer is aluminum, the fins may be machined. For embodiments in which the outer jacket layer is steel, the fins would be produced during the wire arc additive manufacture process.

It should be noted that layer thickness as a function of axial position along the barrel may not be constant for all layers. The thickness of each layer along the axial length may be optimized depending on the particular barrel and application.

The powders for all layers are controlled for the proper particle size distribution and are heat treated. For example, cobalt based alloys can be very hard in an atomized condition; however, after proper heat treatment, these alloys are relatively more plastic which results in higher quality deposits with the desired properties. Using off the shelf powders would not create the same results. Similarly, aluminum powder must be degassed to avoid outgassing during service due to high temperature exposure and to improve the ductility of the deposit.

It should be noted that layer thickness as a function of axial position along the barrel may not be constant for all layers. The thickness of each layer along the axial length may be optimized depending on the particular barrel and application.

FIG. 1 is a flow diagram illustrating a method for manufacturing a gun barrel, in accordance with an illustrative embodiment of the invention. The method comprises the steps of employing a mandrel 102, forming on the mandrel a liner comprising a cobalt superalloy or refractory metal 104, applying to the liner a first coating comprising a nickel material 106, applying to the first coating a second coating comprising a steel material 108, dissolving the mandrel in a chemical solution 110, heat treating the build 112 and applying an outer jacket layer 114.

In step 102, a mandrel is employed in the weapon barrel manufacture process. The outer profile of the mandrel is the negative of the desired inner profile of the weapon barrel. As described above, the geometry and material of the mandrel is chosen such that the mandrel may be dissolved in a chemical solution while still having a thickness meeting the structural needs of the process. In one embodiment, the mandrel is formed of an aluminum alloy and has a thickness of 50% of the build.

In step 104, a liner is formed on the mandrel via a cold spray deposition process. In one embodiment, the liner comprises a cobalt superalloy. In other embodiments, a refractory metal such as Ta-10W may be employed.

In step 106, a first coating is applied to the liner via a cold spray deposition process. The first coating may be nickel or nickel-self-flux. Alternatively, the first coating may comprise a gradient transitioning from nickel to nickel-self-flux. The nickel-self-flux enhances bonding to the liner thereby allowing for a cold sprayed weapon barrel.

In step 108, a second coating is applied to the first coating via a cold spray deposition process or a wire arc additive manufacturing process. The second coating may comprise a steel material. Alternatively, the second coating may comprise an alloy such as an austenitic nickel-chromium-based superalloys like an Inconel alloy or age-hardenable iron base superalloy like A286.

In step 110, the mandrel is dissolved in a chemical solution by circulating the chemical solution within an inner diameter of the mandrel. In embodiments of the invention in which the mandrel is formed of an aluminum alloy, the chemical solution employed to dissolve the mandrel is a caustic solution comprising hydrogen, such as sodium hydroxide. In a continuous fluid flow, sodium hydroxide etches the aluminum evenly. In processes employing a steel mandrel, a nitric acid solution may be used to dissolve the mandrel.

In step 112, the build is heat treated to diffusion bond the liner, the first coating and the second coating. Heat treating the liner, first coating and second coating increases the toughness and ductility of the weapon barrel.

In step 114, an outer jacket layer is applied via a cold spray deposition process. The outer jacket layer may be titanium or aluminum. Alternatively, an outer jacket layer of steel may be wire arc additively manufactured or cold sprayed.

In embodiments of the invention, fins or other features may be formed in the outer jacket layer as described above.

In embodiments of the invention, the method further comprises the step of cooling the mandrel while applying the liner, first coating and second coating to the mandrel via a cold spray deposition process. In an embodiment, the mandrel is cooled by circulating a fluid within the inner diameter of the mandrel.

Figure 2:
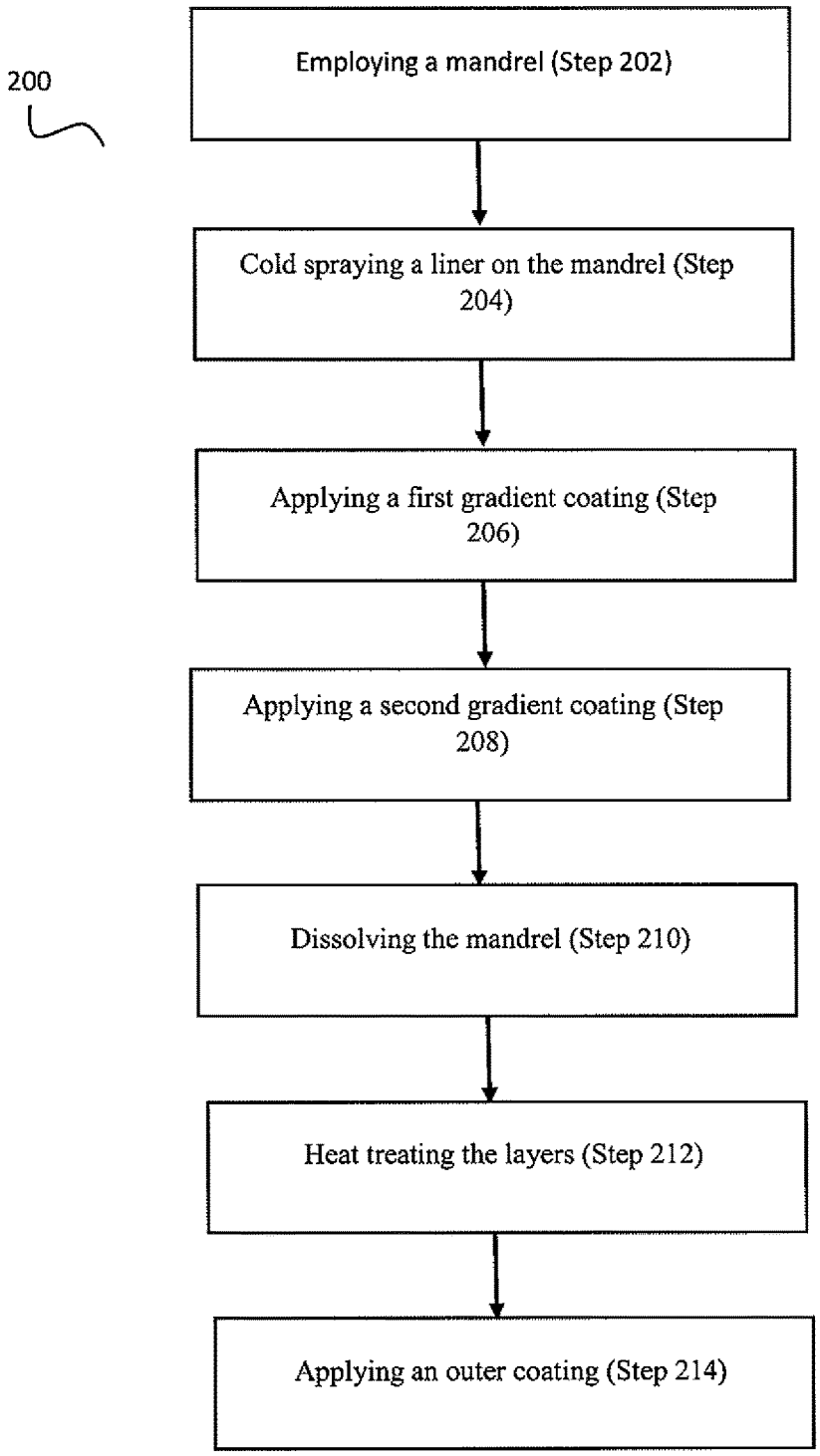
FIG. 2 is a flow diagram illustrating a method for manufacturing a gun barrel, in accordance with an illustrative embodiment of the invention.

FIG. 2 is a flow diagram illustrating a method for manufacturing a gun barrel, in accordance with an illustrative embodiment of the invention. This method allows a cobalt superalloy liner to be combined with a ceramic core, resulting in a high strength, thermally insulative barrel that does not absorb the heat from firing. The brittleness of the ceramic is negated by sandwiching the ceramic between cobalt superalloy and steel. Even if the ceramic should break, the steel layer provides the structural integrity required while the weapon barrel retains the thermal properties. The materials may be graded between layers resulting in a single piece barrel with high bonding between layers.

The method 200 comprises the steps of employing a mandrel 202; forming on the mandrel a liner comprising a cobalt superalloy 204, applying to the liner a first gradient coating 206, applying to the first coating a second coating comprising a gradient 208, dissolving the mandrel in a chemical solution 210, heat treating the build 212 and applying an outer jacket layer 214.

In step 202, a mandrel is employed in the weapon barrel manufacture process. The outer profile of the mandrel is the negative of the desired inner profile of the weapon barrel. As described above, the geometry and material of the mandrel is chosen such that the mandrel may be dissolved in a chemical solution while still having a thickness meeting the structural needs of the process. In one embodiment, the mandrel is formed of an aluminum alloy and has a thickness of 50% of the build.

In step 204, a liner is formed on the mandrel via a cold spray deposition process. In one embodiment, the liner comprises a cobalt superalloy. In other embodiments, a refractory metal such as Ta-10W may be employed.

In step 206, a first coating is applied to the liner via a cold spray deposition process. The first coating comprising a gradient of the liner material (i.e. cobalt superalloy or refractory metal) and a mixture of a ceramic and a metal. The gradient transitions from being substantially the liner material to substantially the mixture of ceramic and metal. In an embodiment, the gradient is a linear gradient. The mixture of ceramic and metal is approximately 75-80% ceramic and 20-25% metal by weight.

In step 208, a second coating is applied to the first coating via a cold spray deposition process. The second coating comprises a gradient of the mixture of ceramic material and metal material and steel. The gradient transitions from substantially the mixture of ceramic material and metal material of the first coating to substantially steel. In an embodiment, the gradient is a linear gradient.

In step 210, the mandrel is dissolved in a chemical solution by circulating the chemical solution within an inner diameter of the mandrel. In embodiments of the invention in which the mandrel is formed of an aluminum alloy, the chemical solution employed to dissolve the mandrel is a caustic solution comprising hydrogen, such as sodium hydroxide. In a continuous fluid flow, sodium hydroxide etches the aluminum evenly. In processes employing a steel mandrel, a nitric acid solution may be used to dissolve the mandrel.

In step 212, the build is heat treated to diffusion bond the liner, the first coating and the second coating. Heat treating the first coating and second coating increases the toughness and ductility of the weapon barrel.

In step 214, an outer jacket layer is applied via a cold spray deposition process. The outer jacket layer may be titanium or aluminum. Alternatively, an outer jacket layer of steel may be wire arc additively manufactured or cold sprayed.

In embodiments of the invention, fins or other features may be formed in the outer jacket layer as described above.

In embodiments of the invention, the method further comprises the step of cooling the mandrel while applying the liner, first coating and second coating to the mandrel via a cold spray deposition process. In an embodiment, the mandrel is cooled by circulating a fluid within the inner diameter of the mandrel.

Figure 3:
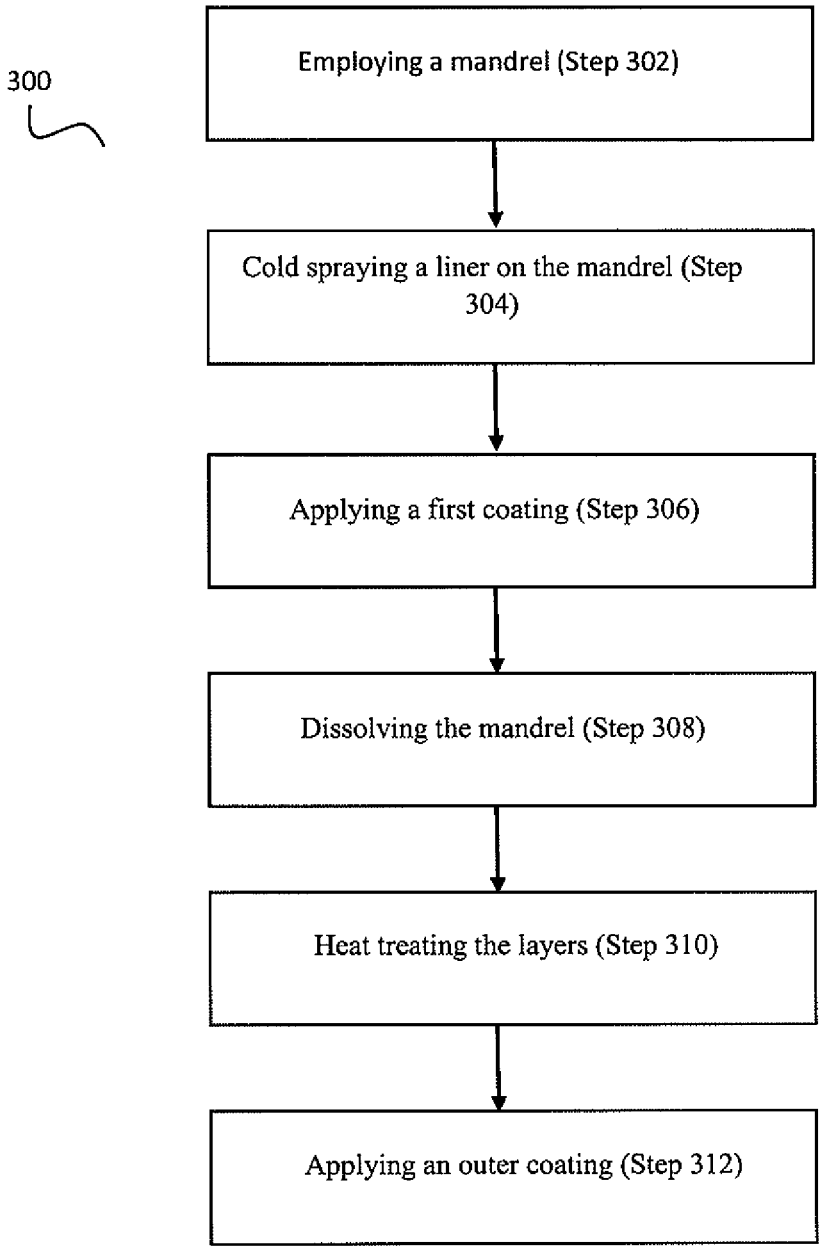
FIG. 3 is a flow diagram illustrating a method for manufacturing a gun barrel, in accordance with an illustrative embodiment of the invention.

FIG. 3 is a flow diagram illustrating a method for manufacturing a gun barrel, in accordance with an illustrative embodiment of the invention. The method is employed to manufacture a weapon having a ceramic barrel. A ceramic barrel has the ability to greatly reduce the amount of heat built up in the barrel due to the insulative properties of ceramic; however, ceramics are brittle. To combat the brittleness, the ceramic is cold sprayed as a mix with a metallic filler, such as cobalt superalloy or high strength maraging steel, at 75-80%. The ceramic metallic mix could have a tendency to dislodge ceramic particles if the correct mix and metallic filler material are not used. Additionally, the materials can be graduated, resulting in a single piece barrel with high strength bonding layers.

The method 300 comprises the steps of employing a mandrel 302, forming on the mandrel a liner comprising a mixture of metal and ceramic material 304, applying to the liner a first coating comprising a gradient of the mixture of ceramic and cobalt superalloy and steel wherein the gradient transitions from substantially the cobalt superalloy to substantially steel 306, dissolving the mandrel in a chemical solution 308, heat treating the build 310 and applying an outer jacket layer 312.

In step 302, a mandrel is employed in the weapon barrel manufacture process. The outer profile of the mandrel is the negative of the desired inner profile of the weapon barrel. As described above, the geometry and material of the mandrel is chosen such that the mandrel may be dissolved in a chemical solution while still having a thickness meeting the structural needs of the process. In one embodiment, the mandrel is formed of an aluminum alloy and has a thickness of 50% of the build.

In step 304, a liner is formed on the mandrel via a cold spray deposition process. In one embodiment, the liner comprises a mixture of metal and ceramic material. In an embodiment, the mixture includes ceramic mixed with cobalt superalloy or similar refractory metal. The ceramic is in the range of approximately 50-80% by volume and the cobalt superalloy or similar metal is in the range of 20-50% by weight.

In step 306, a first coating is applied to the liner via a cold spray deposition process. The first coating comprises a gradient of the liner material (i.e. mixture of ceramic material and metal material) and steel. The steel is high strength steel. Alternatively, Inconel or A286 may be used. The gradient transitions from substantially the mixture of ceramic material and metal material of the first coating to substantially steel. In an embodiment, the gradient is a linear gradient.

In step 308, the mandrel is dissolved in a chemical solution by circulating the chemical solution within an inner diameter of the mandrel. In embodiments of the invention in which the mandrel is formed of an aluminum alloy, the chemical solution employed to dissolve the mandrel is a caustic solution comprising hydrogen, such as sodium hydroxide. In a continuous fluid flow, sodium hydroxide etches the aluminum evenly. In processes employing a steel mandrel, a nitric acid solution may be used to dissolve the mandrel.

In step 310, the build is heat treated to diffusion bond the liner and the first coating. Heat treating the first coating increases the toughness and ductility of the weapon barrel.

In step 312, an outer jacket layer is applied via a cold spray deposition process or WAAM process. The outer jacket layer may be titanium or aluminum or steel. Alternatively, a fourth layer of steel may be wire arc additively manufactured.

In embodiments of the invention, fins or other features may be formed in the outer jacket layer as described above.

In embodiments of the invention, the method further comprises the step of cooling the mandrel while applying the liner, first coating and second coating to the mandrel via a cold spray deposition process. In an embodiment, the mandrel is cooled by circulating a fluid within the inner diameter of the mandrel.

In addition to the use of cold spray, wire arc additive manufacturing technology may be leveraged to manufacture weapon barrels. WAAM is a method of wire arc technology that uses a highly controlled temperature during the wire arc process. Specifically, WAAM may be employed to apply a structural steel layer inside of the weapon barrel. The highly controlled temperature of the wire arc allows for the steel layer to be added without a large heat affected zone that would result from a traditional wire arc. Advantageously, the use of WAAM has the advantage of creating a ductile but tough steel layer that has high bonding strength to the barrel liner.

Figure 4:
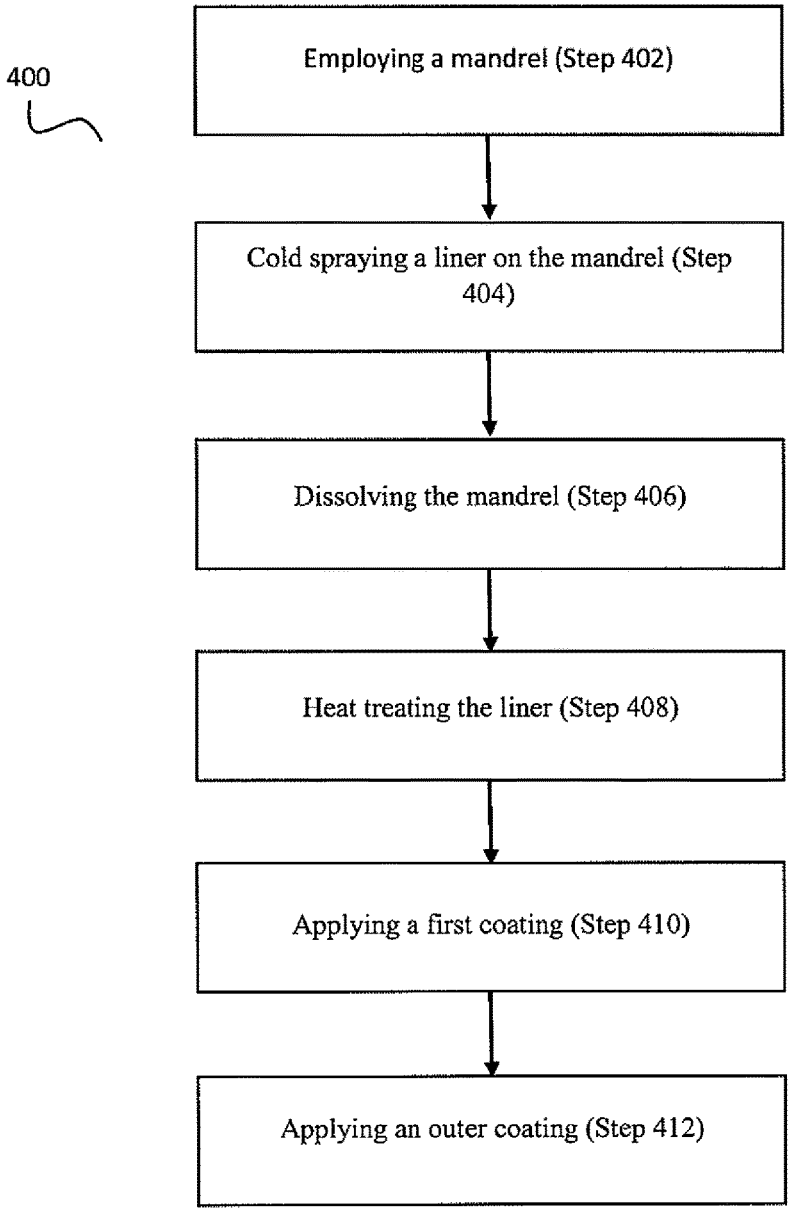
FIG. 4 is a flow diagram illustrating a method for manufacturing a gun barrel, in accordance with an illustrative embodiment of the invention.

FIG. 4 is a flow diagram illustrating a method for manufacturing a gun barrel, in accordance with an illustrative embodiment of the invention. The method comprises the steps of employing a mandrel 402, forming on the mandrel a liner comprising a cobalt superalloy 404, dissolving the mandrel in a chemical solution 406, heat treating the liner 408, applying to the liner a first coating comprising a high strength steel 410 and applying an outer jacket layer 412.

In step 402, a mandrel is employed in the weapon barrel manufacture process. The outer profile of the mandrel is the negative of the desired inner profile of the weapon barrel. As described above, the geometry and material of the mandrel is chosen such that the mandrel may be dissolved in a chemical solution while still having a thickness meeting the structural needs of the process. In one embodiment, the mandrel is formed of an aluminum alloy and has a thickness of 50% of the build.

In step 404, a liner is formed on the mandrel via a cold spray deposition process. In one embodiment, the liner comprises a cobalt superalloy. In other embodiments, a refractory metal such as Ta-10W may be employed.

In step 406, the mandrel is dissolved in a chemical solution by circulating the chemical solution within an inner diameter of the mandrel. In embodiments of the invention in which the mandrel is formed of an aluminum alloy, the chemical solution employed to dissolve the mandrel is a caustic solution comprising hydrogen, such as sodium hydroxide. In a continuous fluid flow, sodium hydroxide etches the aluminum evenly. In processes employing a steel mandrel, a nitric acid solution may be used to dissolve the mandrel.

In step 408, the liner is heat treated to diffusion bond the liner coating. Heat treating the liner increases the toughness and ductility of the weapon barrel. Cobalt superalloy deposited on the mandrel may be brittle until heat treated. As WAAM is a welding process, it will impact stress as a first coating is being deposited on the liner. Accordingly, a ductile liner will be more conducive to manufacture.

Additionally, heat treatment of cobalt superalloys requires a high temperature whereas maraging steel can be heat treated in two ways. A complete heat treatment typically requires a high temperature hold similar to that used for the cobalt superalloy, followed by a quench and then a low temperature hold. The inventors have discovered that during the WAAM process, the deposition process reduces the need for a high temperature heat hold and allows for a lower temperature condition. Accordingly, the cobalt superalloy liner may be heat treated prior to a first coating being applied via WAAM. Only a relatively low temperature treatment is then required for the first coating to age the first coating. This minimizes the stresses due to coefficient of thermal expansion (CTE) differentials. However, in other embodiments, the liner with the first coating may be heat treated subsequent to the application of the first coating.

In step 410, a first coating is applied to the liner via a WAAM process. The first coating may be high strength steel, such as maraging steel. In an embodiment, age hardening alloys are incorporated to avoid the need for quenching.

In step 412, an outer jacket layer is applied via a cold spray deposition or WAAM process. The outer jacket layer may be titanium or aluminum. Alternatively, a fourth layer of steel may be wire arc additively manufactured or cold sprayed.

In embodiments of the invention, fins or other features may be formed in the outer jacket layer as described above.

In embodiments of the invention, the method further comprises the step of cooling the mandrel while applying the liner via a cold spray deposition process. In an embodiment, the mandrel is cooled by circulating a fluid within the inner diameter of the mandrel.

In embodiments of the above method, layers may be graded to further strengthen the bond and eliminate thermal coefficient issues.

Figure 5:
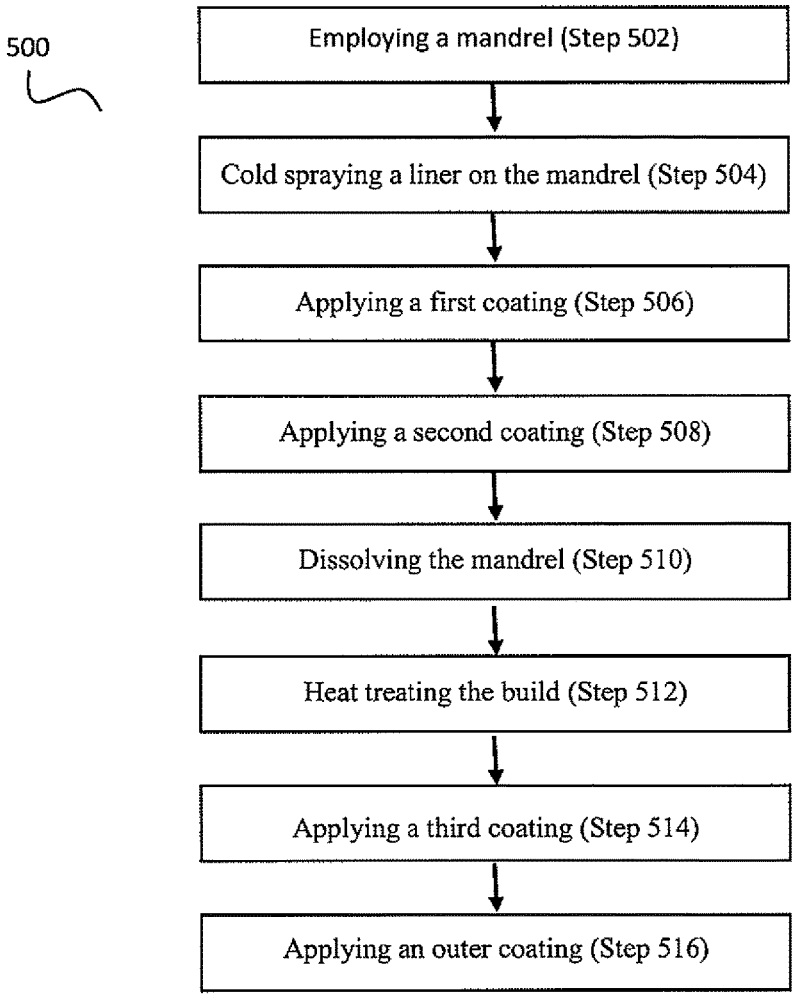
FIG. 5 is a flow diagram illustrating a method for manufacturing a gun barrel, in accordance with an illustrative embodiment of the invention.

FIG. 5 is a flow diagram illustrating a method for manufacturing a gun barrel, in accordance with an illustrative embodiment of the invention. Cobalt superalloy and refractory liners have many advantages for small caliber barrels but bonding of the liner is a weak point in conventional processes. Further, while desirable for its thermal insulative properties and high hardness, a fully ceramic lined barrel is brittle and previous attempts have been unsuccessful. This method allows a cobalt superalloy liner to be combined with a ceramic core, resulting in a high strength, thermally insulative barrel that does not absorb the heat from firing. The brittleness of the ceramic is negated by sandwiching the ceramic between cobalt superalloy and steel. Even if the ceramic should break, the steel layer provides the structural integrity required while the weapon barrel retains the thermal properties. The materials may be graded between layers resulting in a single piece barrel with high bonding between layers.

The method comprises the steps of employing a mandrel 502, forming on the mandrel a liner comprising a cobalt superalloy 504, applying to the liner a first gradient coating 506, applying a second coating comprising cobalt superalloy 508, dissolving the mandrel in a chemical solution 510, heat treating the first coating and second coating 512, applying to the second coating a third coating comprising a high strength steel 514 and applying an outer jacket layer 516.

In step 502, a mandrel is employed in the weapon barrel manufacture process. The outer profile of the mandrel is the negative of the desired inner profile of the weapon barrel. As described above, the geometry and material of the mandrel is chosen such that the mandrel may be dissolved in a chemical solution while still having a thickness meeting the structural needs of the process. In one embodiment, the mandrel is formed of an aluminum alloy and has a thickness of 50% of the build.

In step 504, a liner is formed on the mandrel via a cold spray deposition process. In one embodiment, the liner comprises a cobalt superalloy. In other embodiments, a refractory metal such as Ta-10W may be employed.

In step 506, a first coating is applied to the liner via a cold spray deposition process. The first coating comprising a gradient of the cobalt superalloy and a mixture of a ceramic and a metal. The gradient transitions from being substantially the cobalt superalloy to substantially the mixture of ceramic and metal. In an embodiment, the gradient is a linear gradient. The mixture of ceramic and metal is approximately 75-80% ceramic and 20-25% metal by weight.

In step 508, a second coating is applied to the first coating via a cold spray deposition process. The second coating comprises a cobalt superalloy or refractory metal. The second coating may be a gradient.

In step 510, the mandrel is dissolved in a chemical solution by circulating the chemical solution within an inner diameter of the mandrel. In embodiments of the invention in which the mandrel is formed of an aluminum alloy, the chemical solution employed to dissolve the mandrel is a caustic solution comprising hydrogen, such as sodium hydroxide. In a continuous fluid flow, sodium hydroxide etches the aluminum evenly. In processes employing a steel mandrel, a nitric acid solution may be used to dissolve the mandrel.

In step 512, the build is heat treated to diffusion bond the lining, the first coating and the second coating. Heat treating the liner, first coating and second coating increases the toughness and ductility of the weapon barrel.

In step 514, a third coating is applied via a WAAM process. The third coating may be high strength steel, such as maraging steel. In an embodiment, age hardening alloys are incorporated to avoid the need for quenching . . . .

In step 516, an outer jacket layer is applied via a cold spray deposition or WAAM process. The outer jacket layer may be titanium or aluminum. Alternatively, a fourth layer of steel may be wire arc additively manufactured or cold sprayed.

In embodiments of the invention, fins or other features may be formed in the outer jacket layer as described above.

In embodiments of the invention, the method further comprises the step of cooling the mandrel while applying the liner, first coating and second coating via a cold spray deposition process. In an embodiment, the mandrel is cooled by circulating a fluid within the inner diameter of the mandrel.

Figure 6:
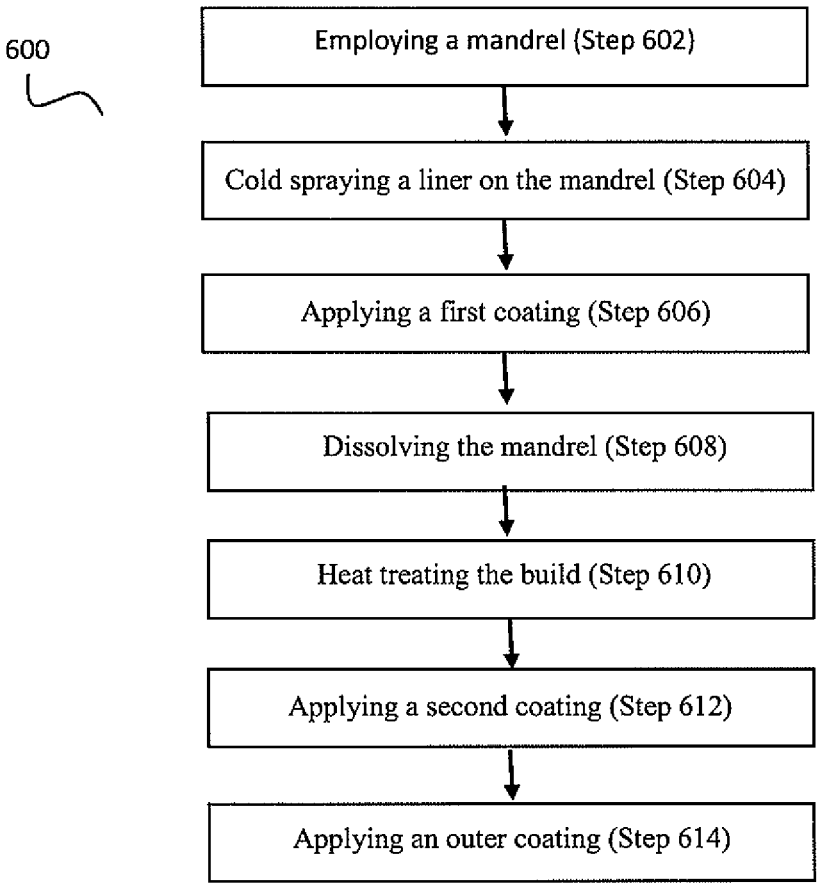
FIG. 6 is a flow diagram illustrating a method for manufacturing a gun barrel, in accordance with an illustrative embodiment of the invention.

FIG. 6 is a flow diagram illustrating a method for manufacturing a gun barrel, in accordance with an illustrative embodiment of the invention. The method is employed to manufacture a weapon having a ceramic barrel. A ceramic barrel has the ability to greatly reduce the amount of heat built up in the barrel due to the insulative properties of ceramic; however, ceramics are brittle. To combat the brittleness, the ceramic is cold sprayed as a mix with a metallic filler, such as cobalt superalloy or high strength maraging steel, at 75-80%. The ceramic metallic mix could have a tendency to dislodge ceramic particles if the correct mix and metallic filler material are not used. Additionally, the materials can be graduated, resulting in a single piece barrel with high bonding layers.

The method 600 comprises the steps of employing a mandrel 602, forming on the mandrel a liner comprising a mixture of metal and ceramic material 604, applying to the liner a first coating comprising steel 606, applying to the first layer a second layer 608, dissolving the mandrel in a chemical solution 610, heat treating the first coating and the second coating 612 and applying an outer jacket layer 614.

In step 602, a mandrel is employed in the weapon barrel manufacture process. The outer profile of the mandrel is the negative of the desired inner profile of the weapon barrel. As described above, the geometry and material of the mandrel is chosen such that the mandrel may be dissolved in a chemical solution while still having a thickness meeting the structural needs of the process. In one embodiment, the mandrel is formed of an aluminum alloy and has a thickness of 50% of the build.

In step 604, a liner is formed on the mandrel via a cold spray deposition process. In one embodiment, the liner comprises a mixture of metal and ceramic material. In an embodiment, the mixture includes ceramic mixed with cobalt superalloy or refractory metal. The ceramic is in the range of approximately 50-80% by volume and the cobalt superalloy or similar metal is in the range of 20-50% by volume.

In step 606, a first coating is applied to the liner via a cold spray deposition process. The first coating comprises cobalt superalloy or another refractory metal. The second coating may comprise a gradient of the mixture of ceramic material and metal material and cobalt superalloy. The gradient transitions from substantially the mixture of ceramic material and metal material of the first coating to substantially steel. In an embodiment, the gradient is a linear gradient.

In step 608, the mandrel is dissolved in a chemical solution by circulating the chemical solution within an inner diameter of the mandrel. In embodiments of the invention in which the mandrel is formed of an aluminum alloy, the chemical solution employed to dissolve the mandrel is a caustic solution comprising hydrogen, such as sodium hydroxide. In a continuous fluid flow, sodium hydroxide etches the aluminum evenly. In processes employing a steel mandrel, a nitric acid solution may be used to dissolve the mandrel.

In step 610, the liner and first coating are heat treated to diffusion bond the liner and the first coating. Heat treating the liner and the first coating increases the toughness and ductility of the weapon barrel.

In step 612, a second coating is applied via a WAAM process. The second coating may be high strength steel, such as maraging steel. In an embodiment, age hardening alloys are incorporated to avoid the need for quenching In step 614, an outer jacket layer is applied via a cold spray deposition or WAAM process. The outer jacket layer may be titanium or aluminum. Alternatively, an outer jacket layer of steel may be wire arc additively manufactured or cold sprayed.

In embodiments of the invention, fins or other features may be formed in the outer jacket layer as described above.

In embodiments of the invention, the method further comprises the step of cooling the mandrel while applying the liner, first coating and second coating to the mandrel via a cold spray deposition process. In an embodiment, the mandrel is cooled by circulating a fluid within the inner diameter of the mandrel.

While the invention has been described with reference to certain embodiments, numerous changes, alterations and modifications to the described embodiments are possible without departing from the spirit and scope of the invention as defined in the appended claims, and equivalents thereof.

What is claimed is:

1. A method for manufacturing a weapon barrel, the method comprising the steps of:

employing a mandrel having a tubular shape;

applying to the mandrel via a cold spray deposition process a liner comprising a cobalt superalloy;

dissolving the mandrel in a chemical solution by circulating the chemical solution within an inner diameter of the mandrel;

heat treating the liner to increase the ductility of the liner;

depositing onto the liner via a wire arc additive manufacture a first coating comprising steel; and applying an outer jacket layer.

2. The method of claim 1 wherein the mandrel is made of aluminum.

3. The method of claim 1 wherein the mandrel has a melting point sufficiently high to maintain integrity while being subjected to a cold spray process having a stagnation temperature in the range of 400-600° c. and a helium gas pressure in the range of approximately 30-40 bar.

4. The method of claim 1 wherein the mandrel is tubular in shape having an interior cavity and the chemical solution is flowed through an inner diameter of the mandrel.

5. The method of claim 1 further comprising the step of cooling the mandrel while applying to the mandrel via a cold spray deposition process the liner comprising the cobalt superalloy.

6. The method of claim 1 wherein the steel is maraging steel.

7. The method of claim 1 wherein the steel incorporates age hardening alloys.

8. The method of claim 1 further comprising the step of heat treating the first coating to age the first coating.

9. The method of claim 1 wherein the step of heat treating the liner to increase the ductility of the liner is performed subsequent to the step of depositing onto the liner via a wire arc additive manufacture a first coating comprising steel.

10. A method for manufacturing a weapon barrel, the method comprising the steps of:

employing a mandrel having a tubular shape;

applying to the mandrel via a cold spray deposition process a liner comprising a cobalt superalloy;

applying to the liner via a cold spray deposition a first coating comprising a gradient of the cobalt superalloy and a mixture of a ceramic and a metal wherein the gradient transitions from substantially the cobalt superalloy to substantially the mixture of ceramic and metal, and wherein the mixture of ceramic and metal is approximately 50-80% ceramic and 20-50% metal by weight;

applying to the first coating via a cold spray deposition process a second coating comprising cobalt superalloy;

depositing on the second coating via a wire arc additive manufacture process a third coating comprising steel;

dissolving the mandrel in a chemical solution by circulating the chemical solution within an inner diameter of the mandrel;

heat treating the first coating and the second coating to diffusion bond the first coating and the second coating; and applying an outer jacket layer.

11. The method of claim 10 wherein the mandrel is made of aluminum.

12. The method of claim 10 wherein the mandrel has a melting point sufficiently high to maintain integrity while being subjected to a cold spray process having a stagnation temperature in the range of 400-600° c. and a helium gas pressure in the range of approximately 30-40 bar.

13. The method of claim 10 wherein the mandrel is tubular in shape having an interior cavity and the chemical solution is flowed through an inner diameter of the mandrel.

14. The method of claim 10 further comprising the step of cooling the mandrel while applying to the mandrel via a cold spray deposition process the liner comprising the cobalt superalloy.

15. The method of claim 10 wherein the steel is maraging steel.

16. The method of claim 10 wherein the steel incorporates age hardening alloys.

17. A method for manufacturing a weapon barrel, the method comprising the steps of:

employing a mandrel having a tubular shape;

applying to the mandrel via a cold spray deposition process a liner comprising a mixture of ceramic and cobalt superalloy;

applying to the liner via a cold spray deposition process a first coating comprising cobalt superalloy;

depositing on the first coating via a wire arc additive manufacture process a second coating comprising steel;

dissolving the mandrel in a chemical solution;

heat treating the first coating and second coating to diffusion bond the first coating and second coating;

applying an outer jacket layer.

18. The method of claim 17 wherein the mandrel is made of aluminum.

19. The method of claim 17 wherein the mandrel has a melting point sufficiently high to maintain integrity while being subjected to a cold spray process having a stagnation temperature in the range of 400-600° c. and a helium gas pressure in the range of approximately 30-40 bar.

20. The method of claim 17 wherein the mandrel is tubular in shape having an interior cavity and the chemical solution is flowed through an inner diameter of the mandrel.

21. The method of claim 17 further comprising the step of cooling the mandrel while applying to the mandrel via a cold spray deposition process a first coating comprising a mixture of ceramic and cobalt superalloy.

22. The method of claim 17 wherein the mixture of ceramic and steel comprises approximately 75 to 80 percent ceramic by weight.

23. The method of claim 17 wherein the gradient is linear.

* * * * *